US008966908B2

(12) United States Patent
Twardochleb et al.

(10) Patent No.: US 8,966,908 B2
(45) Date of Patent: Mar. 3, 2015

(54) PHASE AND AMPLITUDE MATCHED FUEL INJECTOR

(75) Inventors: Christopher Zdzislaw Twardochleb, Alpine, CA (US); Hongyu Wang, San Diego, CA (US); James Wilfrid Blust, San Diego, CA (US); Mario E. Abreu, Poway, CA (US)

(73) Assignee: Solar Turbines Incorporated, San Diego, CA (US)

( * ) Notice: Subject to any disclaimer, the term of this patent is extended or adjusted under 35 U.S.C. 154(b) by 897 days.

(21) Appl. No.: 13/166,981

(22) Filed: Jun. 23, 2011

(65) Prior Publication Data

US 2012/0324900 A1 Dec. 27, 2012

(51) Int. Cl.

| | |
|---|---|
| ***F02C 1/00*** | (2006.01) |
| ***F02G 3/00*** | (2006.01) |
| ***F23R 3/14*** | (2006.01) |
| ***F23R 3/16*** | (2006.01) |
| ***F23R 3/28*** | (2006.01) |

(52) U.S. Cl.

CPC ... *F23R 3/14* (2013.01); *F23R 3/16* (2013.01); *F23R 3/286* (2013.01); *F23C 2900/07001* (2013.01); *F23D 2900/14021* (2013.01); *F23R 2900/00014* (2013.01)

USPC ..... 60/742; 60/737; 60/740; 60/748; 60/772; 60/776

(58) Field of Classification Search

USPC ..... 60/737–748, 772, 776

See application file for complete search history.

(56) References Cited

U.S. PATENT DOCUMENTS

| | | | | |
|---|---|---|---|---|
| 4,070,826 | A | 1/1978 | Stenger et al. | |
| 5,601,238 | A | 2/1997 | Rawlins et al. | |
| 6,164,055 | A | 12/2000 | Lovett et al. | |
| 6,178,752 | B1 | 1/2001 | Morford | |
| 6,298,667 | B1 | 10/2001 | Glynn et al. | |
| 6,460,326 | B2 | 10/2002 | Bechtel et al. | |
| 7,533,531 | B2 | 5/2009 | Prociw et al. | |
| 2001/0018172 | A1 | 8/2001 | Lovett et al. | |
| 2007/0074518 | A1 * | 4/2007 | Rogers et al. | 60/776 |
| 2008/0295519 | A1 | 12/2008 | Park | |

(Continued)

FOREIGN PATENT DOCUMENTS

JP 2001-193932 A 7/2001

*Primary Examiner* — Craig Kim

(74) *Attorney, Agent, or Firm* — Finnegan, Henderson, Farabow, Garrett & Dunner, LLP

(57) ABSTRACT

A fuel injector for a turbine engine may include a body member disposed about a longitudinal axis, and a barrel member located radially outwardly from the body member. The fuel injector may also include an annular passageway extending between the body member and the barrel member from a first end to a second end. The first end may be configured to be fluidly coupled to a compressor of the turbine engine and the second end may be configured to be fluidly coupled to a combustor of the turbine engine. The fuel injector may also include a perforated plate positioned proximate the first end of the passageway. The perforated plate may be configured to direct compressed air into the annular passageway with a first pressure drop. The fuel injector may also include at least one fuel discharge orifice positioned downstream of the perforated plate. The at least one fuel discharge orifice may be configured to discharge a fuel into the annular passageway with a second pressure drop. The second pressure drop may have a value between about the first pressure drop and about 1.75 times the first pressure drop.

20 Claims, 4 Drawing Sheets

(56) References Cited

U.S. PATENT DOCUMENTS

2009/0241547 A1 10/2009 Luts et al.
2009/0320484 A1* 12/2009 Lacy et al. ..... 60/748
2010/0326080 A1 12/2010 Rogers et al.

* cited by examiner

PHASE AND AMPLITUDE MATCHED FUEL INJECTOR

TECHNICAL FIELD

The present disclosure relates generally to a fuel injector for a turbine engine, and more particularly, to a phase and amplitude matched fuel injector for a turbine engine.

BACKGROUND

During operation, turbine engines exhaust a complex mixture of air pollutants. These air pollutants may include oxides of nitrogen ($NO_x$). Exhaust emission standards regulate the amount of $NO_x$ emitted to the atmosphere from a turbine engine depending on the type, size, and/or class of the engine. It is known that a well-distributed flame having a low flame temperature may help to reduce $NO_x$ emission to levels compliant with emission regulations. One way to generate a flame with a low temperature is to premix fuel and air to a create a lean fuel-air mixture. However, naturally occurring combustion induced pressure fluctuations within the combustor of the turbine engine can be amplified during operation of the engine under lean conditions. These amplified pressure fluctuations may induce mechanical vibrations that can damage the turbine engine.

One method to provide a lean fuel-air mixture to a turbine engine while minimizing the harmful vibrations is described in U.S. Patent Publication No. US 2007/0074518 A1 ("the '518 publication") assigned to the assignee of the current application. In the '518 publication, the length of different regions of a fuel nozzle is adjusted such that a magnitude of the fuel to air equivalence ratio reaching the flame front is a minimum when a pressure pulse at the flame front is a maximum. While the method described in the '518 publication is suitable to reduce mechanical vibrations in many applications, other applications may benefit from other means of reducing mechanical vibrations.

The disclosed fuel injector is directed to overcoming one or more of the problems set forth above.

SUMMARY

In one aspect, a fuel injector for a turbine engine is disclosed. The fuel injector includes a body member disposed about a longitudinal axis, and a barrel member located radially outwardly from the body member. The fuel injector may also include an annular passageway extending between the body member and the barrel member from a first end to a second end. The first end may be configured to be fluidly coupled to a compressor of the turbine engine and the second end may be configured to be fluidly coupled to a combustor of the turbine engine. The fuel injector may also include a perforated plate positioned proximate the first end of the passageway. The perforated plate may be configured to direct compressed air into the annular passageway with a first pressure drop. The fuel injector may also include at least one fuel discharge orifice positioned downstream of the perforated plate. The at least one orifice may be configured to discharge a fuel into the annular passageway with a second pressure drop. The second pressure drop may have a value between about the first pressure drop and about 1.75 times the first pressure drop.

In another aspect, a method of operating a turbine engine including a fuel injector fluidly coupling a compressor and a combustor of the turbine engine is disclosed. The method includes directing a compressed air stream into an upstream end of the fuel injector with a first pressure drop. The method may also include directing a fuel with a second pressure drop into the compressed air stream at a location less than or equal to about 0.75 inches downstream of the upstream end. The second pressure drop may have a value between about the first pressure drop and about 1.75 times the first pressure drop. The method may further include delivering the fuel and the compressed air stream to the combustor as a fuel-air mixture.

In yet another aspect, a method of operating a turbine engine is disclosed. The turbine engine may be configured to have a combustion induced pressure wave induced in a combustor of the turbine engine during operation. The method may include directing a fuel-air mixture to the combustor through a fuel injector that has a longitudinal axis. Directing the fuel-air mixture may include directing compressed air into the fuel injector through a perforated plate having a plurality of perforations arranged substantially symmetrically around the longitudinal axis. The compressed air may be subject to a first pressure drop across the perforated plate. Directing the fuel-air mixture may also include directing a fuel into the fuel injector through a plurality of orifices positioned at a first length downstream of the perforated plate. The first length may be less than or equal to about 4% of a wavelength of the pressure wave induced in the combustor. The fuel may be subject to a second pressure drop across the orifices. The second pressure drop may have a value between about the first pressure drop and about 1.75 times the first pressure drop. Directing the fuel-air mixture may also include mixing the fuel in the compressed air to create the fuel-air mixture. The method may further include combusting the fuel-air mixture in the combustor.

DETAILED DESCRIPTION

Figure 1:
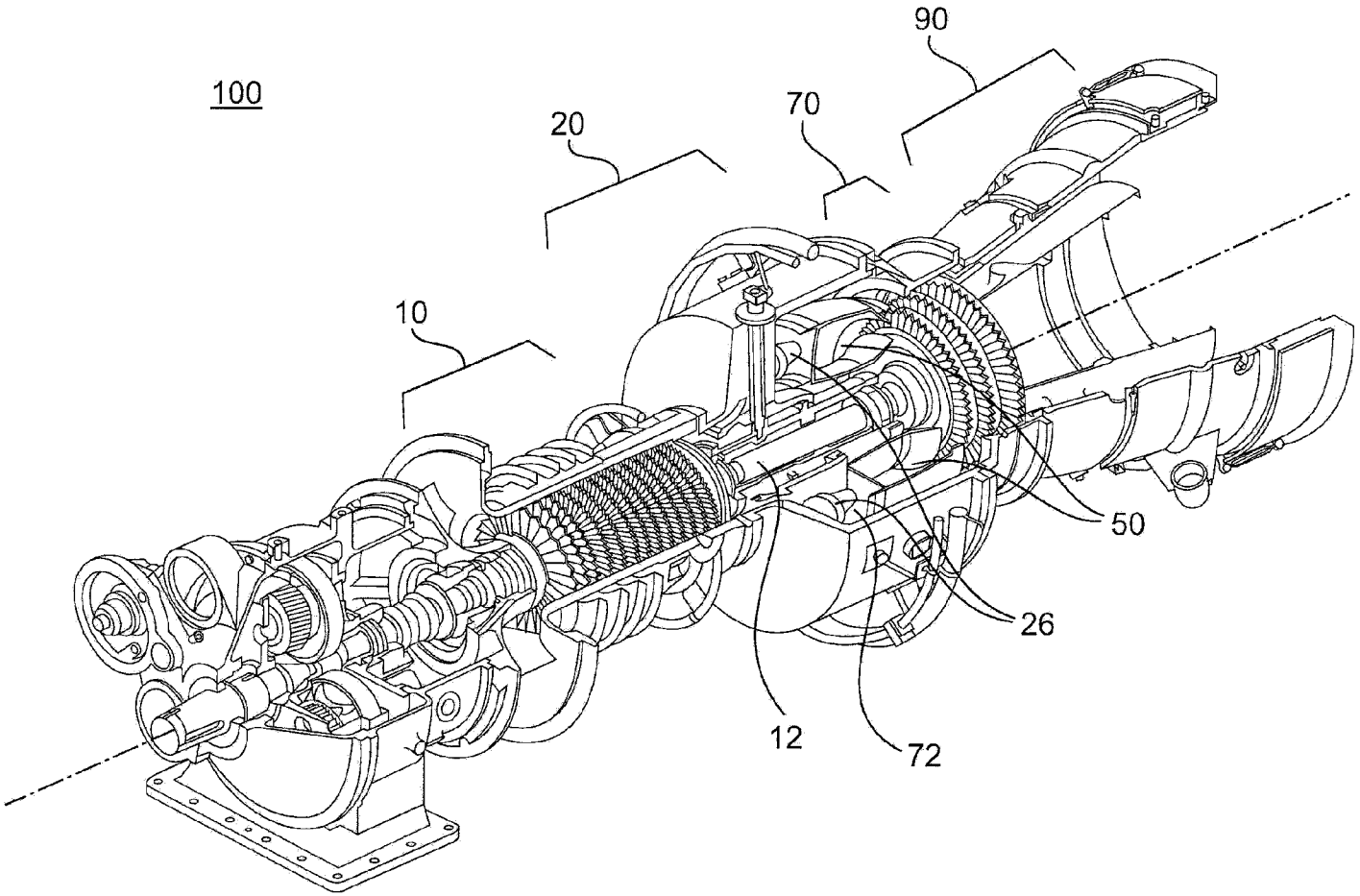
FIG. 1 is a cutaway-view illustration of an exemplary disclosed turbine engine.

FIG. 1 illustrates an exemplary turbine engine 100 that may be associated with a stationary or mobile machine. For example, turbine engine 100 may embody a power source of a generator set that produces electrical power output, or a power source of an earth-moving machine, a passenger vehicle, a marine vessel, or any other type of machine known in the art. Turbine engine 100 may include a compressor section 10, a combustor section 20, a turbine section 70, and an exhaust section 90.

Compressor section 10 may include components rotatable to compress inlet air. Specifically, compressor section 10 may include a series of rotatable compressor blades about a central shaft 12. As the central shaft 12 is rotated, the compressor blades draw air into turbine engine 100 and pressurize the air. This pressurized air may then be directed to an enclosure 72 of the combustor section 20 for mixture with a liquid and/or gaseous fuel. Combustor section 20 includes one or more fuel injectors 26 arranged about the central shaft 12. Compressed air from the enclosure 72 is drawn into these fuel injectors 26, mixed with a fuel, and directed into a combustion chamber (hereinafter "combustor 50") extending around the central shaft 12. In the combustor 50, the fuel-air mixture may combust to produce combustion gases at a high pressure and temperature. These combustion gases are directed to the turbine section 70. Turbine system 70 extracts energy from these combustion gases, and directs the exhaust gases to the atmosphere through exhaust section 90. The layout of the turbine engine 100 illustrated in FIG. 1, and described above, is only exemplary, and fuel injectors 26 of the current disclosure may be used with any configuration and layout of turbine engine 100.

Figure 2A:
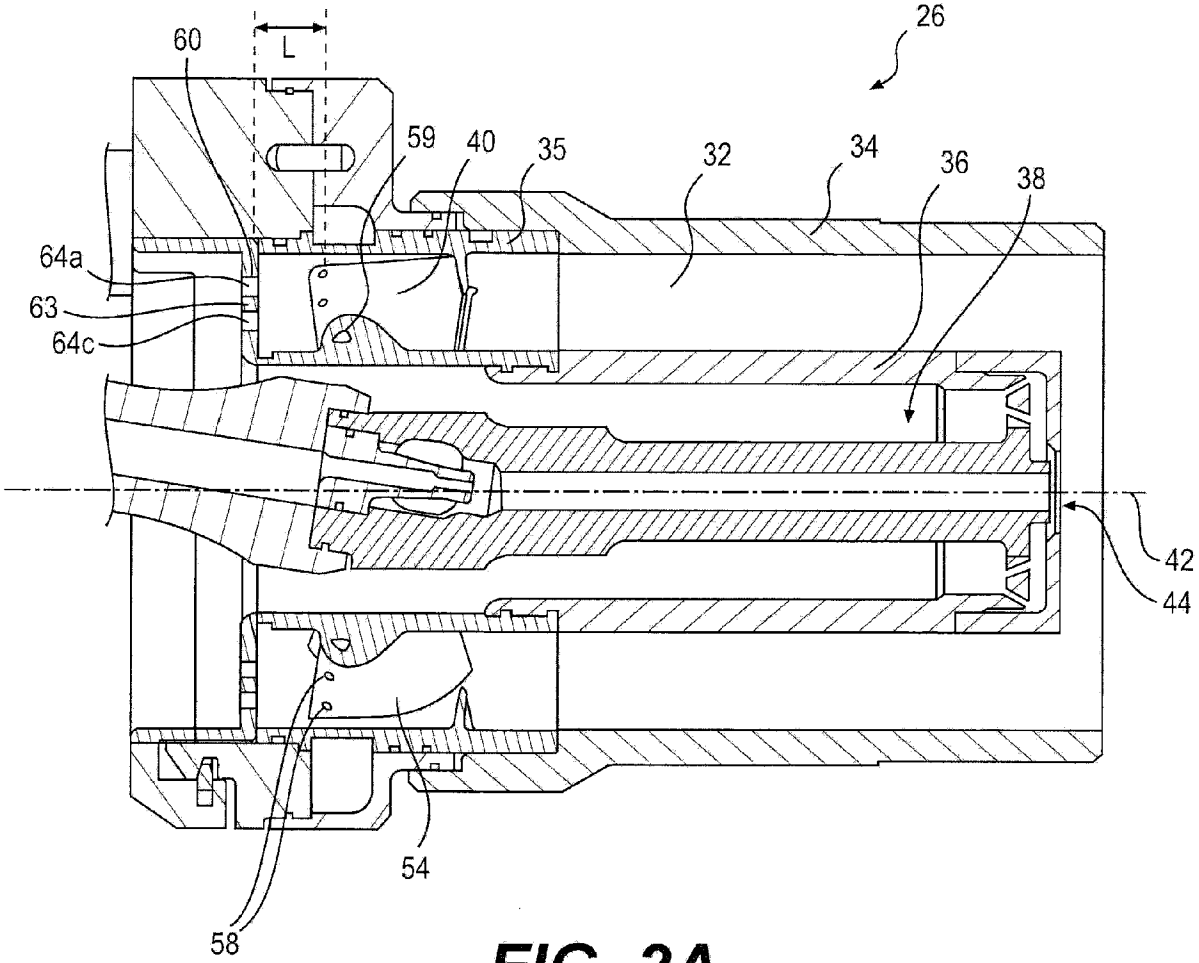
FIG. 2A is a cross-sectional illustration of an exemplary fuel injector of the turbine engine of FIG. 1.

FIG. 2A illustrates a cross-sectional view of an exemplary fuel injector 26 that may be used in turbine engine 100 of FIG. 1. The fuel injector 26 may include components that cooperate to inject gaseous and/or a liquid fuel into the combustor 50. Specifically, each fuel injector 26 may include a barrel housing 34 connected at one end to an air inlet duct 35 for receiving compressed air from enclosure 72, and on the opposing end to the combustor 50. Fuel injector 26 may also include a central body 36, a pilot fuel injector 38, and an air swirler 40. Central body 36 may be disposed radially inwardly of barrel housing 34 and aligned along a longitudinal axis 42 of the fuel injector 26. Pilot fuel injector 38 may be located within the central body 36 and configured to inject a pilot stream of pressurized fuel through a tip end 44 of central body 36 into combustor 50. The pilot stream of fuel may facilitate engine starting, idling, cold operation, and/or lean burn operations of turbine engine 100. Air swirler 40 may be annularly disposed between barrel housing 34 and central body 36 in the air inlet duct 35.

Barrel housing 34 may be a tubular member disposed radially outwardly of the central body 36 to define an annular passageway 32 therebetween. The annular passageway 32 may receive a fuel-air mixture from the air inlet duct 35 at an upstream end and discharge the fuel-air mixture into the combustor 50 at a downstream end. The air inlet duct 35 may be a tubular member configured to receive compressed air from the enclosure 72 at an upstream end, mix the compressed air with fuel, and discharge the fuel-air mixture into the annular passageway 32 at a downstream end. The air inlet duct 35 may include a perforated plate 60 at the upstream end opposite the barrel housing 34. The perforated plate 60 may control the amount of air that enters the fuel injector 26 from the enclosure 72.

Figure 2B:
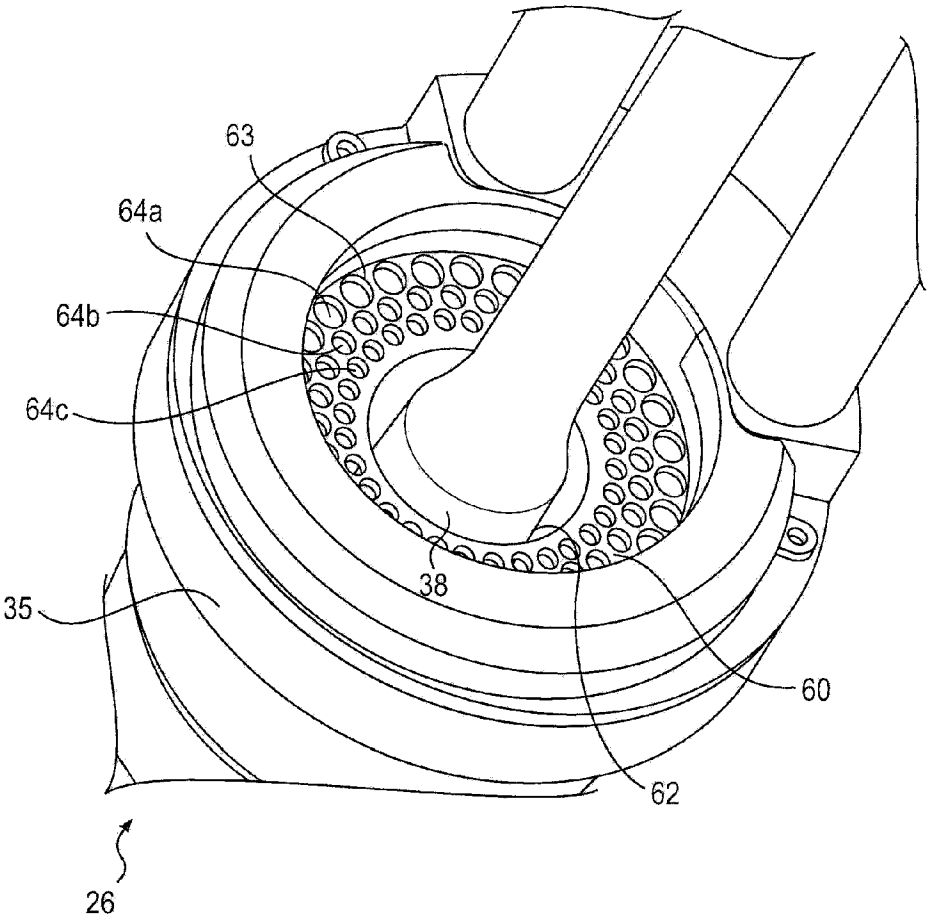
FIG. 2B is a perspective view of the exemplary fuel injector of FIG. 2A.

FIG. 2B illustrates a perspective view of the upstream end of fuel injector 26 when viewed from enclosure 72 (see FIG. 1). In the discussion that follows, reference will be made to both FIGS. 2A and 2B. The perforated plate 60 may include a plate 63 having a plurality of annularly positioned perforations that direct air into the air inlet duct 35. Radially inwardly of the annularly positioned perforations, the perforated plate 60 may include a central opening 62. When attached to the fuel injector 26, the pilot fuel injector 38 may pass through the central opening 62 to define an annular opening between the plate 63 and the pilot fuel injector 38. Compressed air from the enclosure 72 may enter the fuel injector 26 through this annular opening, and flow into the combustor 50 through an annular passageway formed between the central body 36 and the pilot fuel injector 38.

The plurality of perforations of the plate 63 may include a plurality of first perforations 64*a*, a plurality of second perforations 64*b*, and a plurality of third perforations 64*c*. The first perforations 64*a*, the second perforations 64*b*, and the third perforations 64*c* may be annularly positioned about the longitudinal axis 42. In some embodiments, the second perforations 64*b* may be positioned radially outwardly of the third perforations 64*c*, and radially inwardly of the first perforations 64*a*. In some embodiments, the first, second, and third perforations 64*a*, 64*b*, 64*c* may be substantially circular. In some embodiments, the diameter of second perforations 64*b* may be greater than the diameter of the third perforations 64*c* and smaller than the diameter of the first perforations 64*a*. As the compressed air flows into the air inlet duct 35 through the first, second, and third perforations 64*a*, 64*b*, 64*c*, the compressed air will experience a pressure drop $\Delta P_{air}$ and an increase in velocity due to flow restrictions caused by the perforated plate 60. The geometry of the perforated plate 60 may be such that pressure fluctuations within air inlet duct 35 are minimized to provide a uniform flow of air through air inlet duct 35. The arrangement of the first, second, and third perforations 64*a*, 64*b*, 64*c* on the perforated plate 60 may reduce the distortions (or skew) in the velocity profile of the air in the air inlet duct 35.

With reference to FIG. 2A, air swirler 40 may be positioned in the air inlet duct 35 downstream of the perforated plate 60. The air swirler 40 may include an annulus with a plurality of vanes 54 connected thereto. As the compressed air flows across the vanes 54, a swirl may be imparted to the compressed air. Some or all of vanes 54 may include a plurality of gaseous fuel orifices 58 at the upstream side (or the leading edge) of the vanes 54. The number and arrangement of the orifices 58 in a vane 54 may depend upon the application. Although, in general, fuel injector 26 may include any number of vanes 54 and any number or orifices 58 per vane 54, in some embodiments, the air swirler 40 may include twelve vanes 54, and each vane may include forty orifices 58. The orifices 58 may direct a gaseous fuel (hereinafter "fuel") into the air stream flowing in the air inlet duct 35. Any type of gaseous fuel, such as, for example, natural gas, landfill gas, bio-gas, or any other suitable gaseous fuel may be directed into the fuel injector 26 through the orifices 58. Each of the orifices 58 may be in communication with a gaseous fuel gallery 59 that receives the gaseous fuel from an external source (not shown). The orifices 58 may have a geometry that induces a pressure drop $\Delta P_{gas}$ in the fuel entering the fuel injector 26. As the fuel enters the air inlet duct 35 through the orifices 58, the fuel mixes with the compressed air flowing across the air swirler 40 to form a fuel-air mixture. This fuel-air mixture enters the combustor 50 through the annular passageway 32 of the barrel housing 34. In embodiments where the fuel injector 26 is configured to operate on both a liquid fuel and a gaseous fuel (that is, a dual fuel injector), some or all of these vanes 54 may also include liquid fuel jets (not shown) that are configured to inject a liquid fuel into the air stream in the air inlet duct 35. While the current disclosure is applicable to a fuel injector that delivers a gaseous fuel and/or a liquid fuel to the combustor 50, for the sake of brevity, an exemplary embodiment of a fuel injector 26 that delivers a gaseous fuel to the combustor 50 is discussed herein.

Combustor 50 (referring to FIG. 1) may house the combustion process. Combustor 50 may be configured to receive the mixed fuel-air mixture through the barrel housing 34 of each fuel injector 26. This fuel-air mixture may be ignited and combusted within the combustor 50. As the fuel-air mixture combusts, an expanding flame front is created. Due to the variations in the fuel-air mixture directed into the combustor 50 through different fuel injectors 26, circumferential pressure fluctuations may be induced in the combustor 50. These pressure fluctuations emanate from the flame front and propagate as a sinusoidal pressure wave into the fuel injectors 26 against the flow of fuel and air. In general, the frequency of the pressure wave depends on the application (such as, for example, the geometry of the combustor, etc.). As the pressure wave moves past the orifices 58 and the perforated plate 60, the flow of fuel and air into the fuel injector 26 may be affected.

Figure 3:
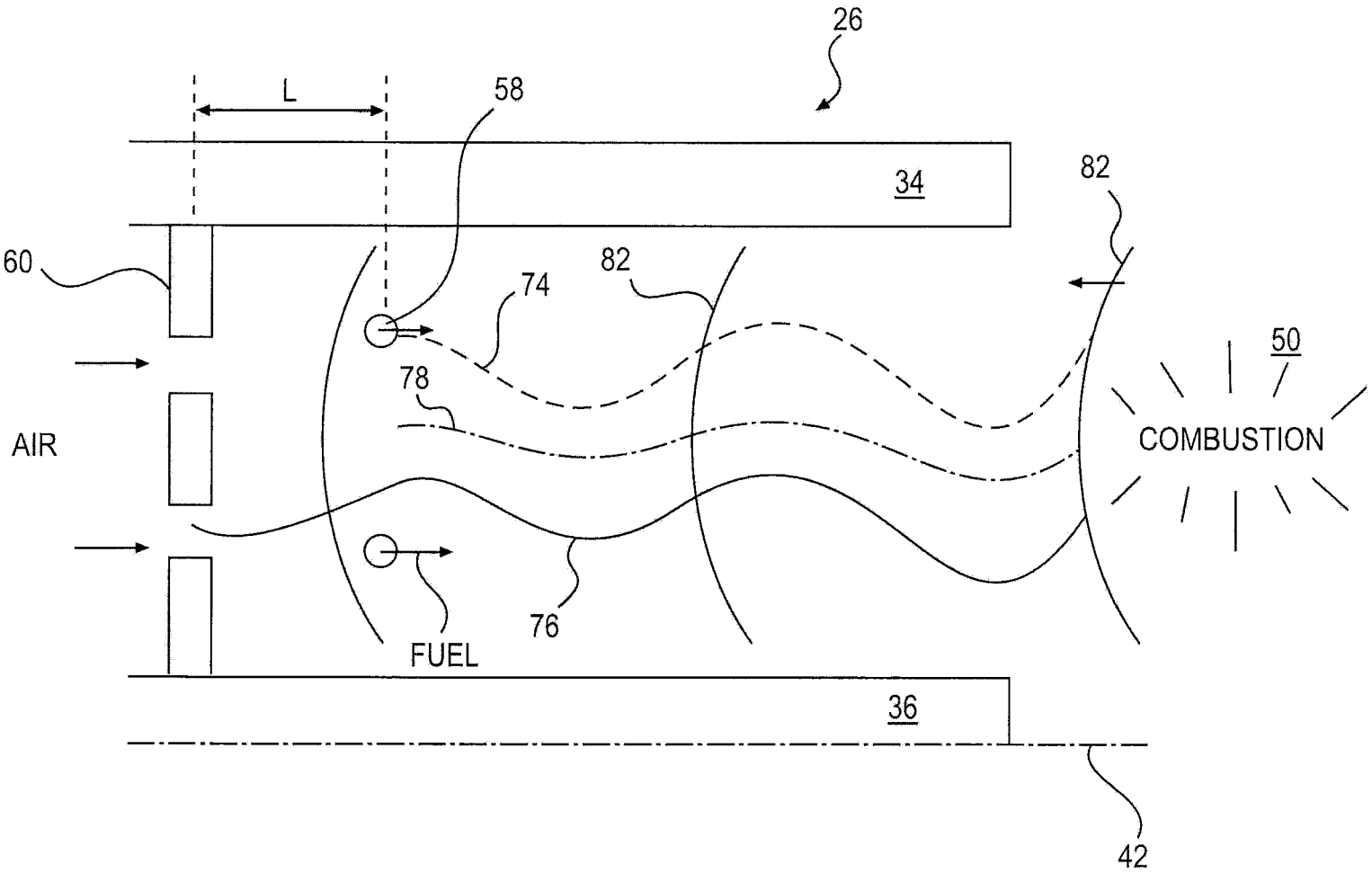
FIG. 3 is a pictorial representation of an exemplary disclosed operation of the fuel injector of FIG. 2A.

FIG. 3 illustrates the effect of the combustion induced pressure wave 82 on the time-varying flow characteristics of fuel and air through the fuel injector 26. As pressure wave 82 moves past an orifice 58, the pressure drop $\Delta P_{gas}$ across the orifice 58 changes. As a peak of the sinusoidal pressure wave 82 reaches the orifice 58, $\Delta P_{gas}$ decreases, and the mass flow of fuel exiting the orifice 58 decreases. And, as a valley of the sinusoidal pressure wave reaches the orifice 58, $\Delta P_{gas}$ increases, and the mass flow of fuel exiting the orifice 58 increases. Thus, because of the combustion induced pressure wave 82 in the combustor 50, the flow of fuel entering the fuel injector 26 through the orifices 58 varies sinusoidally. Fuel curve 74 represents the time-varying flow of fuel through the fuel injector 26. Similarly, as the sinusoidal pressure wave 82 passes the perforated plate 60, the pressure drop $\Delta P_{air}$, and the flow of compressed air entering the air inlet duct 35 through the perforated plate 60 also varies sinusoidally. Air curve 76 represents the time-varying flow of compressed air through the fuel injector 26.

The fuel exiting the orifices 58 mixes with the air entering the air inlet duct 35 and forms a fuel-air mixture. The ratio of fuel to air in the fuel-air mixture to the stoichiometric fuel to air ratio is referred to as the equivalence ratio. If the mass flow of fuel and air entering the fuel injector 26 is a constant over time, the equivalence ratio will be a constant. However, since the amount of fuel and air entering the fuel injector 26 varies sinusoidally, the equivalence ratio also varies sinusoidally, as represented by equivalence ratio curve 78. Thus, the equivalence ratio of the fuel-air mixture reaching the combustor 50 may vary in a sinusoidal manner with time. When the value of equivalence ratio reaching the combustor 50 is high (compared to a time averaged value), the heat release and resulting pressure wave 82 within the combustor 50 may be high. Likewise, when the value of equivalence ratio is low, the heat release and resulting pressure wave 82 within the combustor 50 may be low. Thus, the time-varying equivalence ratio may exacerbate the combustion induced pressure waves 82 in the combustor 50.

If the orifices 58 and the perforated plate 60 are positioned proximate each other compared to a wavelength ($\lambda$) of the pressure wave 82 (for example, about $\leq$4% of $\lambda$), the fuel curve 74 will be in phase with the air curve 76. When the fuel and air curves 74, 76 are in phase, the peaks and valleys of the curves match. Matching the phase of the fuel and air curves 74, 76 is referred to as phase-matching. Phase-matching the fuel and air curves 74, 76 reduces the amplitude of the equivalence ratio curve 78. The distance between the orifices 58 and the perforated plate 60 needed for phase-matching depends upon the application. In some embodiments of fuel injector 26, the distance "L" between the orifices 58 and the perforated plate 60 is less than or equal to about 4% of the wavelength ($\lambda$) of the pressure wave 82, so that the air and fuel flow through the fuel injector 26 are phase-matched. In some embodiments of fuel injector 26, the distance L may be less than or equal to about 2% of the wavelength of the pressure wave 82.

In a typical fuel injector, the pressure drop of fuel $\Delta P_{gas}$ is significantly higher than the pressure drop of air $\Delta P_{air}$ (for example, in some fuel injectors, $\Delta P_{gas}$ may be greater than or equal to $3\Delta P_{air}$). Because of the higher pressure drop, as is known to a person of ordinary skill in the art, the pulsation in the fuel flow caused due to the pressure wave 82 will be smaller than the pulsation in the air flow. Therefore, the amplitude of the fuel curve 74 will be smaller than the amplitude of the air curve 76. Because of this difference in amplitudes, the mass of fuel entering the fuel injector 26 through an orifice 58, and the mass of air entering the fuel injector 26 through the perforated plate 60, will change differently with time. This difference in variation of the mass of fuel and air with time changes the fuel to air ratio (and therefore, the equivalence ratio) of the fuel-air mixture in the fuel injector 26. Therefore, phase-matching the fuel and air curves 74, 76 may not, by itself, minimize the amplitude of the equivalence ratio curve 78. If the magnitude of the mass pulsation of the fuel and air are the same (that is, the amplitudes of the fuel curve 74 and the air curve 76 are the same), then the ratio of the fuel and air entering the fuel injector 26 at an instant of time may be the same. Matching the phase and the amplitude of the fuel and air curves 74, 76 may make the equivalence ratio substantially a constant over time.

The variation in mass pulsations (of the fuel and air) is a function of the respective pressure drops of the fuel and air (that is, $\Delta P_{gas}$ and $\Delta P_{air}$), and other characteristics of the fluids (such as, for example, the density). Decreasing $\Delta P_{gas}$ may increase the pulsation of the fuel flow and make the amplitude of the fuel curve 74 approach the amplitude of the air curve 76. Since the orifices 58 are positioned proximate the perforated plate 60 (compared to the wavelength of the pressure wave 82) in fuel injectors 26 of the current disclosure, sufficient amplitude matching of the fuel and air curves 74, 76 may be achieved if $\Delta P_{gas}$ is less than or equal to about $1.75\Delta P_{air}$. Decreasing the pressure drop of the fuel $\Delta P_{gas}$ may be achieved in any manner. In some embodiments, the size (for example, the diameter) of the orifices 58 may be increased to decrease $\Delta P_{gas}$. As known to a person of ordinary skill in the art, a compressible flow orifice equation may be used to calculate the pressure drop of the fuel $\Delta P_{gas}$ across an orifice 58 having a known size.

Amplitude-matching, along with phase-matching, may minimize the amplitude of the equivalence ratio curve 78, and thereby reduce the pressure wave 82 in the combustor 50. The exact percentage increase of $\Delta P_{gas}$ over $\Delta P_{air}$ for amplitude-matching may depend upon the application. In general, in fuel injectors 26 of the current disclosure, $\Delta P_{gas}$ may be between about $\Delta P_{air}$ and about 1.75 times $\Delta P_{air}$ (that is, $\Delta P_{air} \leq \Delta P_{gas} \leq$ about 1.75 times $\Delta P_{air}$) to decrease the amplitude of the equivalence ratio curve 78. In some embodiments of fuel injector 26, $\Delta P_{gas}$ is between about $\Delta P_{air}$ and about 1.5 times $\Delta P_{air}$ (that is, $\Delta P_{air} \leq \Delta P_{gas} \leq$ about 1.5 times $\Delta P_{air}$).

INDUSTRIAL APPLICABILITY

The disclosed fuel injector may be applicable to any turbine engine where reduced combustion induced oscillations are desired. Although particularly useful for low $NO_x$-emitting turbine engines, the disclosed fuel injector may be applicable to any turbine engine regardless of the emission output of the engine. The disclosed fuel injector may reduce combustion induced oscillations by phase and amplitude matching the fuel and air flows through the fuel injector. The operation of fuel injector 26 will now be explained.

During operation of turbine engine 100, air may be drawn into compressor section 10 and compressed (referring to FIG. 1). This compressed air may then be directed into combustor 50 through a plurality of fuel injectors 26. As the compressed air flows through a fuel injector 26, fuel may be directed into the air stream through a plurality of orifices 58 of the fuel injector 26 to create a fuel-air mixture. As the fuel-air mixture enters combustor 50, the mixture may ignite and combust. The hot expanding exhaust gases may then be directed into turbine section 70 to extract energy therefrom.

With reference to FIG. 3, variations in the fuel-air mixture directed into the combustor 50 through different fuel injectors 26 may induce a sinusoidal pressure wave 82 in the combustor 50. This pressure wave 82 may cause the equivalence ratio of the fuel-air mixture entering the combustor 50 through a fuel injector 26 to vary sinusoidally. The variation of the equivalence ratio may be minimized by phase-matching and amplitude-matching the fuel and air flows through the fuel injector 26. Phase-matching may be accomplished by positioning the fuel orifices 58 at a distance L of less than, or equal to, about 4% of the wavelength of the pressure wave 82 from the perforated plate 60. Amplitude-matching may be accomplished by keeping the pressure drop of the fuel entering the fuel injector 26 ($\Delta P_{gas}$) to between about $\Delta P_{air}$ and about 1.75 times $\Delta P_{air}$.

In some embodiments, a distance L between the orifices 58 and the perforated plate 60 of less than or equal to about 0.75 inches (19.05 mm) may result in phase matching. In an exemplary fuel injector 26 used in an application where a wavelength λ of the pressure wave 82 is about 36 inches (about 914.4 mm), a distance L between the orifices 58 and the perforated plate 60 of about 0.5 inches (12.7 mm) (that is, about 1.4% of λ) results in phase-matching. In an exemplary embodiment of a fuel injector 26 having four hundred and eighty (480) orifices 58, each having a diameter of about 0.04 inches (about 1.02 mm), $\Delta P_{gas}$ is reduced from greater than about 130% of $\Delta P_{air}$ to about 20% of $\Delta P_{air}$ by increasing the diameter of each orifice 58 to about 0.05 inches (about 1.27 mm). Phase and amplitude-matching of the fuel and air flows may efficiently minimize the pressure waves without substantially increasing cost of the fuel injector and the turbine engine.

It will be apparent to those skilled in the art that various modifications and variations can be made to the disclosed fuel injector. Other embodiments will be apparent to those skilled in the art from consideration of the specification and practice of the disclosed fuel injector. It is intended that the specification and examples be considered as exemplary only, with a true scope being indicated by the following claims and their equivalents.

What is claimed is:

1. A fuel injector for a turbine engine, comprising:

a body member disposed about a longitudinal axis;

a barrel member located radially outwardly from the body member;

an annular passageway extending between the body member and the barrel member from a first end to a second end, the first end configured to be fluidly coupled to a compressor of the turbine engine and the second end configured to be fluidly coupled to a combustor of the turbine engine;

a perforated plate, having a plurality of perforations, positioned proximate the first end of the passageway, the perforated plate being configured to direct compressed air into the annular passageway with a first pressure drop; and at least one fuel discharge orifice positioned downstream of the perforated plate, the at least one fuel discharge orifice being configured to discharge a fuel into the annular passageway with a second pressure drop, the second pressure drop having a value between about the first pressure drop and about 1.75 times the first pressure drop.

2. The fuel injector of claim 1, wherein the second pressure drop has a value between about the first pressure drop and about 1.5 times the first pressure drop.

3. The fuel injector of claim 1, wherein a distance between the at least one fuel discharge orifice and the perforated plate is less than or equal to about 4% of a wavelength of a combustion induced pressure wave induced in the combustor during operation of the turbine engine.

4. The fuel injector of claim 1, wherein a distance between the at least one fuel discharge orifice and the perforated plate is less than or equal to about 2% of a wavelength of a combustion induced pressure wave induced in the combustor during operation of the turbine engine.

5. The fuel injector of claim 1, wherein a distance between the at least one fuel discharge orifice and the perforated plate is less than or equal to about 0.75 inches.

6. The fuel injector of claim 1, wherein the perforated plate includes a plurality of perforations arranged substantially symmetrically around the longitudinal axis.

7. The fuel injector of claim 6, wherein the plurality of perforations include a first array of perforations having a substantially constant first diameter, and a second array of perforations spaced radially inwardly of the first array and having a substantially constant second diameter smaller than the first diameter.

8. The fuel injector of claim 1, further including an air swirler having a plurality of vanes positioned in the annular passageway, the at least one fuel discharge orifice being positioned on a first vane of the plurality of vanes.

9. The fuel injector of claim 8, wherein the at least one fuel discharge orifice includes a plurality of fuel discharge orifices positioned on an upstream side of the first vane.

10. The fuel injector of claim 1, wherein the at least one fuel discharge orifice is configured to discharge a gaseous fuel into the annular passageway.

11. A method of operating a turbine engine including a fuel injector fluidly coupling a compressor and a combustor of the turbine engine, comprising:

directing a compressed air stream into an upstream end of the fuel injector with a first pressure drop;

directing a fuel with a second pressure drop into the compressed air stream at a location less than or equal to about 0.75 inches downstream of the upstream end, wherein the second pressure drop has a value between about the first pressure drop and about 1.75 times the first pressure drop; and delivering the fuel and the compressed air stream to the combustor as a fuel-air mixture.

12. The method of claim 11, wherein directing the fuel includes directing the fuel into the compressed air stream with a second pressure drop having a value between about the first pressure drop and about 1.5 times the first pressure drop.

13. The method of claim 11, wherein directing the compressed air stream includes directing compressed air into the upstream end of the fuel injector through a perforated plate, the perforated plate including a plurality of perforations arranged substantially symmetrically around a longitudinal axis of the fuel injector.

14. The method of claim 11, wherein directing a fuel includes directing a gaseous fuel into the compressed air stream.

15. The method of claim 11, wherein directing a fuel includes directing the fuel into the compressed air stream through a plurality of fuel discharge orifices positioned on an air swirler of the fuel injector.

16. A method of operating a turbine engine configured to have a combustion induced pressure wave induced in a combustor of the turbine engine during the operation, including:

directing a fuel-air mixture to the combustor through a fuel injector having a longitudinal axis, including:

directing compressed air into the fuel injector through a perforated plate having a plurality of perforations arranged substantially symmetrically around the longitudinal axis, the compressed air being subject to a first pressure drop across the perforated plate;

discharging a fuel into the fuel injector through a plurality of fuel discharge orifices positioned at a first length downstream of the perforated plate, the first length being less than or equal to about 4% of a wavelength of the pressure wave induced in the combustor, and the fuel being subject to a second pressure drop across the fuel discharge orifices, wherein the second pressure drop has a value between about the first pressure drop and about 1.75 times the first pressure drop;

mixing the fuel in the compressed air to create the fuel-air mixture; and combusting the fuel-air mixture in the combustor.

17. The method of claim 16, wherein discharging the fuel includes discharging a gaseous fuel into the compressed air, and the first length is less than or equal to about 2% of the wavelength of the pressure wave.

18. The method of claim 16, wherein the second pressure drop has a value between about the first pressure drop and about 1.5 times the first pressure drop.

19. The method of claim 16, wherein discharging the fuel includes discharging a fuel through a plurality of fuel discharge orifices positioned on an air swirler of the fuel injector.

20. The method of claim 16, wherein the first length is about 0.5 inches.

* * * * *